US005478430A

United States Patent [19]

Marchetti

[11] Patent Number: 5,478,430

[45] Date of Patent: Dec. 26, 1995

[54] GUMMED PAPER TAPING UNIT WITH IMPROVED ACCESS TO THE PATH OF THE PAPER

[76] Inventor: Augusto Marchetti, Piazza Sicilia, 7, 20146 Milano, Italy

[21] Appl. No.: 371,892

[22] Filed: Jan. 12, 1995

Related U.S. Application Data

[63] Continuation of Ser. No. 92,829, Jul. 19, 1993, abandoned.

[30] Foreign Application Priority Data

Jul. 17, 1992 [IT] Italy ..... MI92U0710

[51] Int. Cl.[6] ..... B32B 31/00

[52] U.S. Cl. ..... 156/468; 156/486; 156/522; 156/578

[58] Field of Search ..... 156/212, 468, 156/475, 486, 522, 578, 579, 583.8; 53/376.3, 376.4, 376.5, 377.2, 377.3; 271/225, 234, 235, 236

[56] References Cited

U.S. PATENT DOCUMENTS

| | | | |
|---|---|---|---|
| 3,196,591 | 7/1965 | Guido et al. | 53/137 |
| 3,466,843 | 9/1969 | Mumper | 156/486 X |
| 4,266,762 | 5/1981 | Kraemer et al. | 271/236 X |
| 4,392,911 | 7/1983 | Ulrich et al. | 156/468 |
| 4,805,892 | 2/1989 | Calhoun | 271/236 X |
| 4,832,330 | 5/1989 | Picton | 271/236 |

FOREIGN PATENT DOCUMENTS

| | | |
|---|---|---|
| 0465771 | 1/1992 | European Pat. Off. . |
| 000407 | 2/1992 | Italy . |

*Primary Examiner*—James Engel
*Attorney, Agent, or Firm*—Cushman Darby & Cushman

[57] ABSTRACT

A machine for applying gummed paper tape to boxes to be sealed comprises a supporting unit adapted to support a roll of gummed paper tape, a control unit, a tape centering unit, a contrast unit, a feeding unit for moving the tape through the machine, a cutting unit for cutting the tape into strips to be applied to the boxes to be sealed, and a diverting unit including at least two guide portions defining a space therebetween for directing the tape into a substantially vertical path of travel. The guide portions are separable from one another to increase the space therebetween and thereby facilitate access to the tape at the space. A moistening unit moistens the tape before the tape is applied to the boxes to be sealed, and an application unit applies the tape to the boxes to be sealed after the tape has been directed into the substantially vertical path of travel by the diverting unit and moistened by the moistening unit.

4 Claims, 2 Drawing Sheets

GUMMED PAPER TAPING UNIT WITH IMPROVED ACCESS TO THE PATH OF THE PAPER

This is a continuation of application Ser. No. 08/092,829, filed on Jul. 19, 1993, which was abandoned upon the filing hereof.

BACKGROUND OF THE INVENTION

The present invention relates to a gummed paper taping unit with improved access to the path of the paper.

It is well known that sealing machines are units used to operate the seal of the bottom and of the top of parallelepiped boxes with turned-over flaps, through the use of adhesive tape or gummed paper. In particular this latter solution has assumed considerable importance over the course of the past few years, in relation to the growing needs linked with ecological problems.

Sealing machines, either with adhesive tape or with gummed paper, comprise a base for supporting boxes to be sealed, means for moving the boxes associated with said supporting base and two taping units, one lower and one upper for sealing the bottom and the top of the boxes, respectively.

With reference to sealing machines with gummed paper, taping units are such as that described in the Italian patent application No. MI92A000407 filed 25 Feb. 1992, on behalf of the present inventor, which comprise a plurality of individual units that can be divided into separate units, including a supporting unit for a roll of gummed paper tape, a unit for controlling the tape, a centering unit and a unit for feeding the same, a contrast unit co-operating with the above-mentioned feeding unit, a tape cutting unit, a unit for moistening and a unit for the application of the tape to the top or to the bottom of a box.

The use of gummed paper creates a drawback in such taping units since it is relatively easy for the paper itself to jam, especially in the presence of dampness and when the machine is allowed to remain at a standstill for a period of time with the tape in it.

Such a drawback imposes a requirement that the construction of the gummed paper taping units reduces the possibilities of jamming and, at the same time, allows easy and simple intervention on part of the operator for the possible removal of the same.

For this purpose the above-mentioned taping units have a tape feeding unit that can be separated from the contrast unit, to uncover a substantial part of the path of the tape upstream from the moistening and application units.

In such gummed paper taping units, there remains a problem with accessing the paper tape in the area between the cutting unit and the moistening unit, where the tape is forced to pass through a unit for diverting the tape towards a perfectly vertical direction suitable for the application of the tape to the front of the box to be sealed.

Such a deviation unit is in fact constituted by two guide portions cooperable in a reciprocal position that cannot be changed in any way.

SUMMARY OF THE INVENTION

The object of the present invention is thus to provide a taping unit for sealing with gummed paper, of the type described previously, wherein problem associated with the passage of the tape through the abovementioned deviation unit is solved.

According to the invention such object is attained by a taping unit comprising, succession, a unit for supporting a roll of gummed paper tape, a tape control unit, a tape centering unit, a unit for feeding the tape integral with a rotating plate, a contrast unit integral with a fixed plate opposing said rotating plate and cooperating with it to define a tape path that can be opened for access, a cutting unit, a unit for directing or diverting the tape towards a vertical direction, a moistening unit, and a unit for the application of the tape to a box to be sealed. The deviation unit comprises at least two guide portions cooperating to define a space for passage of the tape therebetween, wherein one of said guide portions of the diverting unit can be moved integrally with the rotating plate to permit access to the space between the abovementioned portions.

It is clear that a taping unit obtained in this way, wherein the section of path of the tape inside the diverting unit can also be opened for the purpose of maintenance and unjamming the tape.

These and other features of the invention shall be made more evident by the following detailed description of one of its embodiments, illustrated as non-limiting examples in the attached drawings; wherein:

DESCRIPTION OF THE PREFERRED EMBODIMENT

Figure 1:
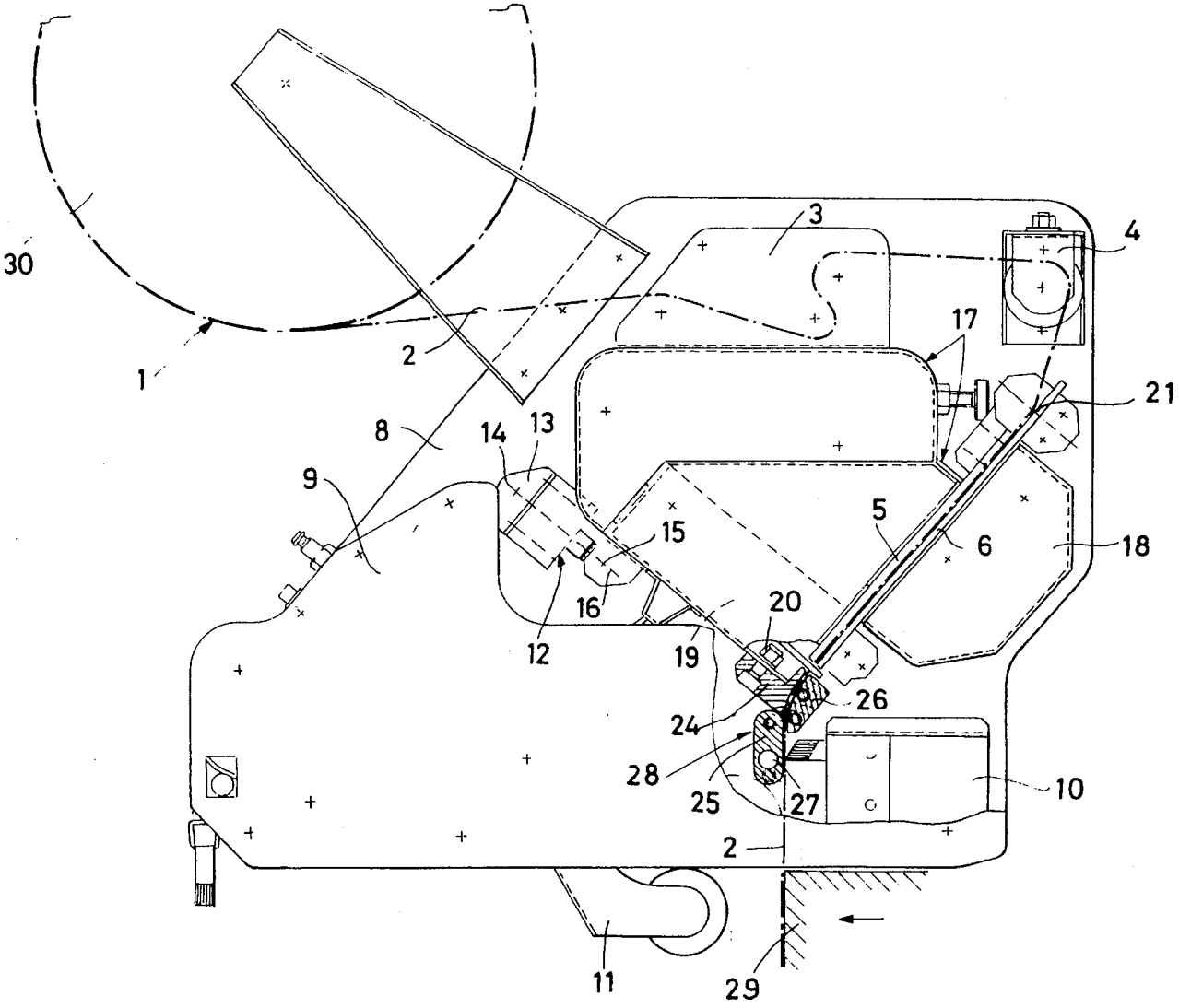
FIG. 1 shows a taping unit according to the invention, in a lateral view, under normal operating conditions.

With reference to FIG. 1, the taping unit according to the invention is constituted essentially by a plurality of individual units that can be fastened to a lateral supporting shoulder 8 to which, on the opposite side, there corresponds a lower lateral containment shoulder 9.

More specifically, the taping unit comprises a unit 1 for supporting a roll 30 of gummed paper tape 2, a tape control unit 3, a centering unit 4, a pair of plates 5 and 6 cooperating for the guidance and movement of the tape, a tape feeding unit 17 and a contrast unit 18, associated respectively with the two plates 5 and 6 to determine the intermittent forward movement of the tape in relation to the machine's operating cycle, a cutting unit 19 associated with the feeding unit 17 to separate sections of tape of a preset length from the continuous tape taken from the roll 30, a moistening unit 10 for moistening the face of the paper tape provided with glue and an application unit 11 suitable for executing the application of the section of separated and moistened tape on the box to be sealed.

The movement of the tape from the pair of plates 5 and 6 to the moistening unit 10 is executed by having the tape pass through a tape diverting unit 28, consisting of three guide portions 24, 25 and 26, that divert the path of the tape towards an exactly vertical direction, suitable for the application of the tape to the front of a box 29 to be sealed.

The construction features and the methods of operation of the above-mentioned units, are of the type described in the previously mentioned Italian patent application, and will not be described here in detail; it will be sufficient to mention that the two plates 6 and 5 in the at rest position (FIG. 1) are opposed to one another and that they are integral with the contrast unit 18 and the feeding unit 17, respectively, which in turn comprise the cutting unit 19 and are integral with the control unit 3. It will also be mentioned, as will be appreciated by those skilled in the art, that the contrast unit 18 is a member having the integrally formed plate 6, which plate 6 opposes plate 5 to define a tape path therebetween. The contrast unit 18 cooperates with the feeding unit 17, as aforementioned, to govern the intermittent movement of tape through the machine.

As can be appreciated from the aforementioned Italian patent application, the plate 5 can rotate on an axis determined by a pivot 21 that is separably fastened to the shoulder 8.

Dissolved at the exit of the plate 5 is the above-mentioned guide portion 24 of the deviation unit 28, rigidly connected to the external structure of the cutting unit 19 through a screw and nut 20.

The second guide portion 26 of the deviation unit 28, that is integral with the shoulder 8, opposes the first guide portion 24, and is positioned so as to form a thin space therebetween for the passage of the tape toward the moistening unit 10.

Adjacent to the guide portion 24 of the deviation unit 28, and at a terminal portion of the above-mentioned guide portion 26, the third guide portion 25 of the deviation unit 28 is rigidly connected to the shoulder 8 in a vertical position, This latter portion 25 opposes the force exerted by the moistening unit 10 on the tape, keeping the latter in a position so as to allow the completion of the moistening operation in a uniform manner.

According to a preferred embodiment, the above-mentioned guide portion 25 can be provided with a resistor 27 to heat the tape of gummed paper at the moment of moistening thus facilitating the activation of the glueing mass.

With the units 19, 17, 3 and plate 5, that, as has already been said, are integral with one another, there cooperates a disengagement unit 12 consisting of a pneumatic cylinder 13 hinged at 14 on the shoulder 8 and with the stem connected through a joint at 15 to a bracket 16 fastened to the external cover of the unit 17.

Figure 2:
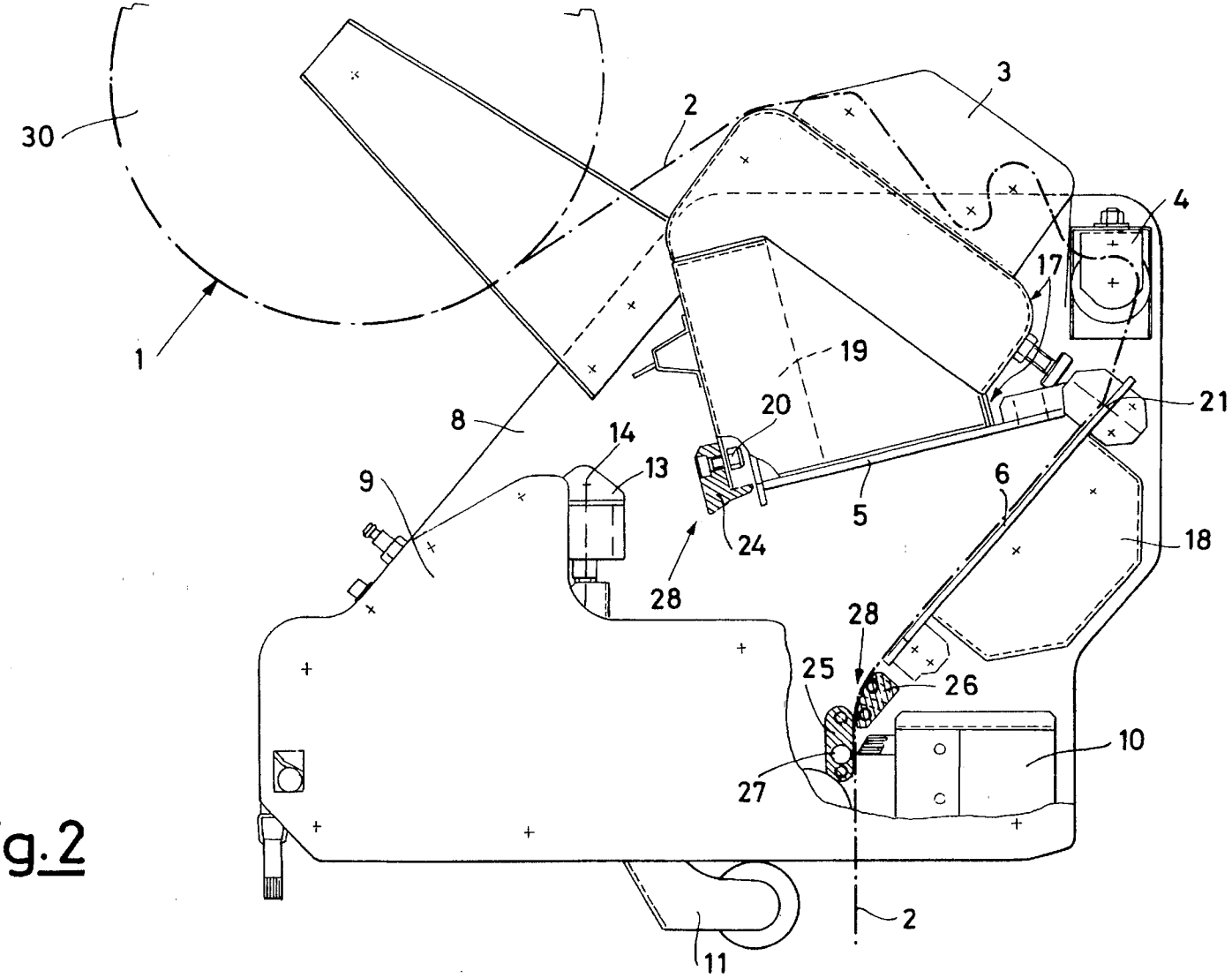
FIG. 2 shows the same unit of FIG. 1, still in a lateral view, but in an opened condition.

The cylinder 13 acts on the plate 5 so as to produce a rotation of the aforementioned integral units about the axis determined by the pivot 21, thus moving the plate 5 away from the opposite plate 6 see (FIG. 2). In this manner the path of the tape between the two plates 5 and 6 can be opened for purposes of maintenance or, in the case of extended stops and in the presence of dampness, the path can be left opened to prevent the tape from sticking to one of the plates and thereby causing a subsequent jam.

As illustrated in FIG. 2 the operation of the cylinder 13 also produces rotation, again about axis in 21, of the guide portion 24 of the deviation unit 28, since this guide portion is rigidly connected at 20 to the unit 19, which is in turn integral with the plate 5. On the other hand, the guide portions 26 and 25 of the deviation unit 28 remain fixed in their initial position, as can be observed by comparing FIGS. 1 and 2.

The movement of the guide portion 24 away from the guide portion 26, in a manner similar to what has been said in relation to the movement of the plates 5 and 6 away from one another, causes the path of the tape of gummed paper through the deviation unit 28 to open, thus avoiding the glueing of the same in case of long stoppages and in the presence of dampness.

In this regard it should be noted that jams at the above-mentioned diverting unit 28 are in general more than jams at other parts of the taping unit. This is largely due the shape of the unit 28 itself, which must allow for a considerable deviation of the direction of motion of the tape, which moistening unit especially in the vicinity of the moistening unit 10, that is provided with a water tank not shown in the figure.

The guide portion 25 of the deviation unit 28 has a particular shape with chamfered extremities and a short section extending along the portion at which it meets the guide portion 26 so as to greatly reduce the probability of tape jams while the machine is not in operation even though the machine cannot be opened at these portions. The aforementioned shape. The path can be left open, also substantially facilitates operations for removing jammed tape.

What is claimed is:

1. A machine for applying gummed paper tape to boxes to be sealed comprising:

a supporting unit adapted to support a roll of gummed paper tape;

a control unit and tape centering unit for cooperatively controlling and guiding the gummed paper tape through the machine;

a contrast unit and an opposing feeding unit for defining a tape path therebetween, said feeding unit being cooperable with said contrast unit to intermittently move the tape through the machine;

a cutting unit for cutting the tape into strips to be applied to said boxes to be sealed;

a diverting unit including three guide portions defining a space therebetween for directing the tape into a substantially vertical path of travel, said three guide portions being separable from one another to increase said space therebetween and thereby facilitate access to said tape at said space, said three guide portions including a movable first guide portion, a fixed second guide portion, and a fixed third guide portion, said movable first guide portion forming an interface with a predetermined portion of said fixed second guide portion, and said fixed third guide portion disposed downstream from said movable first guide portion and forming an interface with a relatively larger portion of said fixed second guide portion than said predetermined portion, said first guide portion being movable away from said fixed second and third guide portions;

a moistening unit for moistening the tape before said tape is applied to said boxes to be sealed; and an application unit for applying the tape to said boxes to be sealed after the tape has been directed into said substantially vertical path of travel by said diverting unit and moistened by said moistening unit.

2. The machine according to claim 1, wherein said fixed third guide portion has chamfered surfaces shaped to enhance accessibility to the path of tape travel.

3. The machine according to claim 1, wherein the contrast unit is fixed and the feeding unit is pivotally connected with the machine and thereby pivotally movable away from the contrast unit to permit access to a path of tape travel therebetween.

4. The machine according to claim 3, wherein said space between said guide portions is disposed between said movable first guide portion and said fixed second guide portion, and wherein the movable first guide portion is fixed to said feeding unit and the fixed second guide portion is fixed to said contrast unit so that movement of the feeding unit away from the contrast unit permits access to said path of tape travel therebetween and access to the space between the first and second guide portions.

* * * * *